US008641561B2

(12) United States Patent
Suppan

(10) Patent No.: US 8,641,561 B2
(45) Date of Patent: Feb. 4, 2014

(54) BASEBALL/SOFTBALL TRAINING POUCH

(76) Inventor: Michael J. Suppan, Granada Hills, CA (US)

( * ) Notice: Subject to any disclaimer, the term of this patent is extended or adjusted under 35 U.S.C. 154(b) by 199 days.

(21) Appl. No.: 13/005,323

(22) Filed: Jan. 12, 2011

(65) Prior Publication Data

US 2011/0172036 A1 Jul. 14, 2011

Related U.S. Application Data

(60) Provisional application No. 61/282,276, filed on Jan. 12, 2010.

(51) Int. Cl.
*A63B 69/00* (2006.01)

(52) U.S. Cl.
USPC ..... 473/458

(58) Field of Classification Search
USPC ..... 473/422, 450, 451, 458, 464, 59; 2/16, 2/158
See application file for complete search history.

(56) References Cited

U.S. PATENT DOCUMENTS

| | | | | |
|---|---|---|---|---|
| 3,843,126 | A | 10/1974 | Bandy | |
| 4,220,333 | A | 9/1980 | Mercer | |
| 4,477,075 | A | 10/1984 | Outman | |
| 7,244,197 | B1 | 7/2007 | Kucek | |
| 2009/0069128 | A1 * | 3/2009 | Bilsey et al. | 473/461 |

FOREIGN PATENT DOCUMENTS

| | | | |
|---|---|---|---|
| JP | 08266697 | A * | 10/1996 |
| JP | 11244438 | A * | 9/1999 |

OTHER PUBLICATIONS

Kuramoto, JP 11-244438 Translation, Pitching Training Instrument, Sep. 14, 1999.*

* cited by examiner

*Primary Examiner* — Mark Graham
(74) *Attorney, Agent, or Firm* — Richard C. Litman

(57) ABSTRACT

A baseball/softball training pouch is a training device for perfecting the mechanics and kinetics needed for effective pitching and throwing of a baseball or softball. The training device is adapted to be worn on the wrist of the throwing hand of a user. Fabricated from an elastic material, the device is configured as a pouch having an open end and a closed end. An observation member is provided to allow a user or coach to view the inside of the pouch during a practice session to analyze the user's gripping and finger placement techniques.

6 Claims, 3 Drawing Sheets

BASEBALL/SOFTBALL TRAINING POUCH

CROSS-REFERENCE TO RELATED APPLICATION

This application claims the benefit of U.S. Provisional Patent Application Ser. No. 61/282,276, filed Jan. 12, 2010.

BACKGROUND OF THE INVENTION

1. Field of the Invention

The present invention generally relates to athletic equipment, and particularly to a baseball/softball training pouch provided as a training device utilized to develop and/or refine the mechanics of throwing or pitching a baseball or softball.

2. Description of the Related Art

A key to becoming an effective pitcher is mastering the mechanics and kinetics (gripping, wrist and finger movement, etc.) of throwing a baseball or softball. Perfecting the needed techniques requires many hours of practice. Heretofore it has been necessary to enlist the aid of another person (catcher) to retrieve a thrown ball to achieve an efficient practice session. This scenario involved making arrangements with the other person to avoid scheduling conflicts. Often, the scheduling cannot be coordinated and a desired practice session has to be cancelled. It would certainly be convenient if a device were available so that an efficient practice session could be accomplished without the need of a second person. Thus, a baseball/softball training pouch solving the aforementioned problems is desired.

SUMMARY OF THE INVENTION

The baseball/softball training pouch is a training device for perfecting the mechanics and kinetics needed for effective pitching and throwing a baseball or softball. The training device is adapted to be worn on the wrist of the throwing hand of a user. Fabricated from spandex or a similar elastic material, the device is configured as a pouch having an open end and a closed end. The closed end of the pouch may have a device to record the potential velocity of a ball thrown into the pouch. The training pouch may permit a user or coach to view the inside of the pouch during a practice session to analyze the user's grip and finger placement techniques. The length of the pouch will be determined based on throwing specifications.

Accordingly, the invention presents a training device that allows a user to practice essentially all phases related to throwing a baseball or softball without the need of a second person to function as a retriever. The device does not restrict the normal throwing motion of the user and allows instant retrieval of the ball. The invention incorporates means to measure the impact and/or velocity of the thrown ball and includes openings for observing finger placement and gripping techniques. Usable in relatively confined areas, the training device is ideal for off-season practice and as a tool for rehabilitating injuries to the arm, wrist or shoulder. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
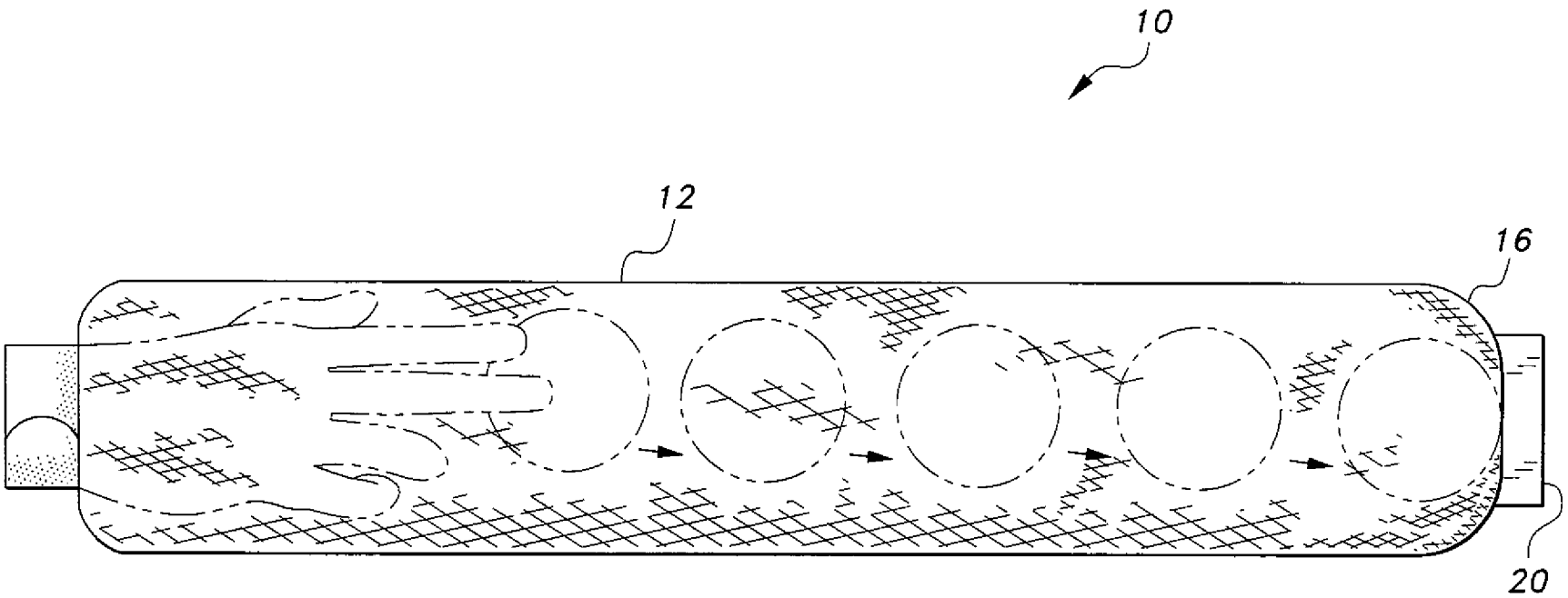
FIG. 1 is an environmental view of a baseball/softball training pouch according to the present invention.
Figure 2:
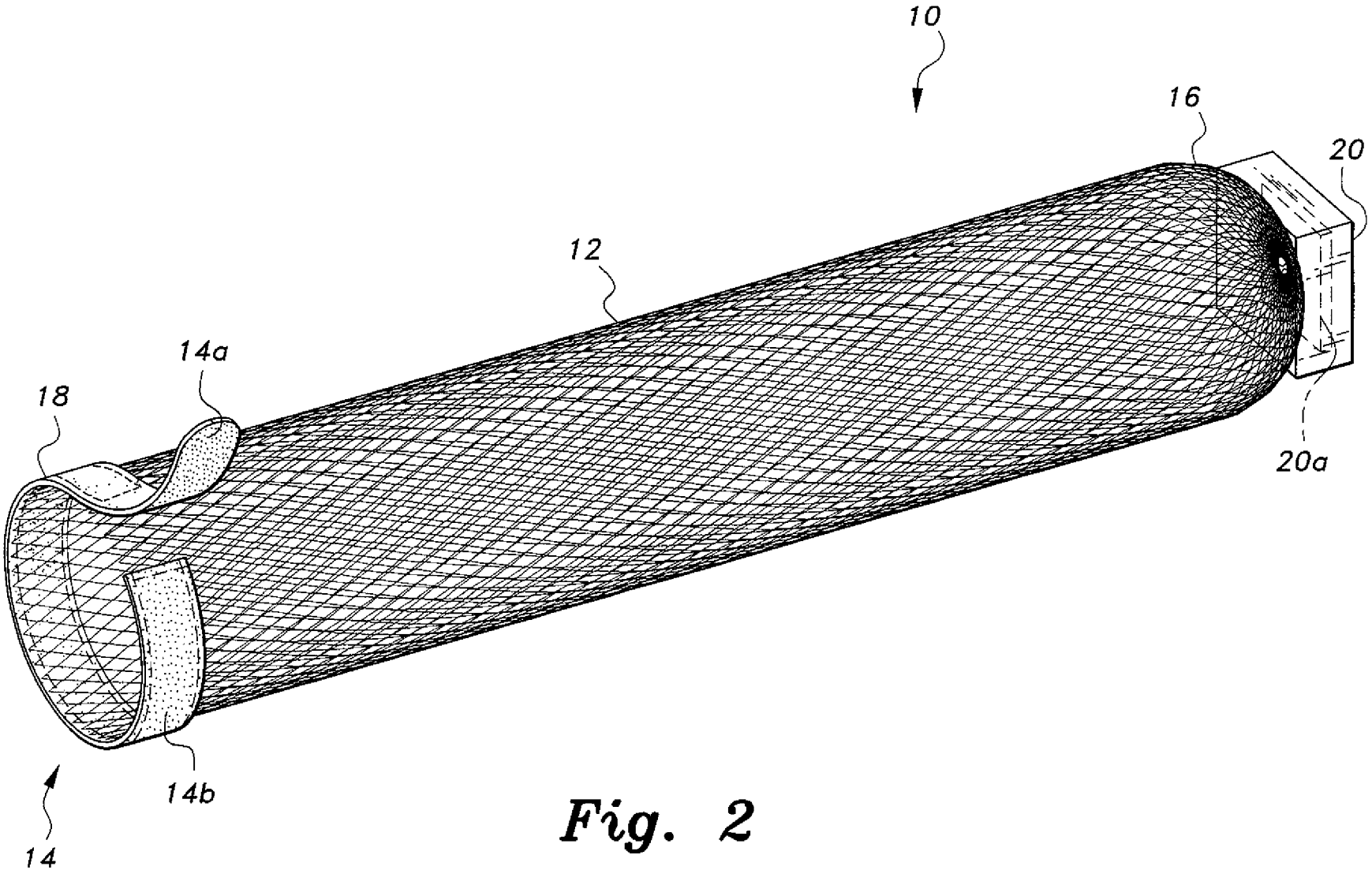
FIG. 2 is a perspective view of a baseball/softball training pouch according to the present invention.
Figure 3:
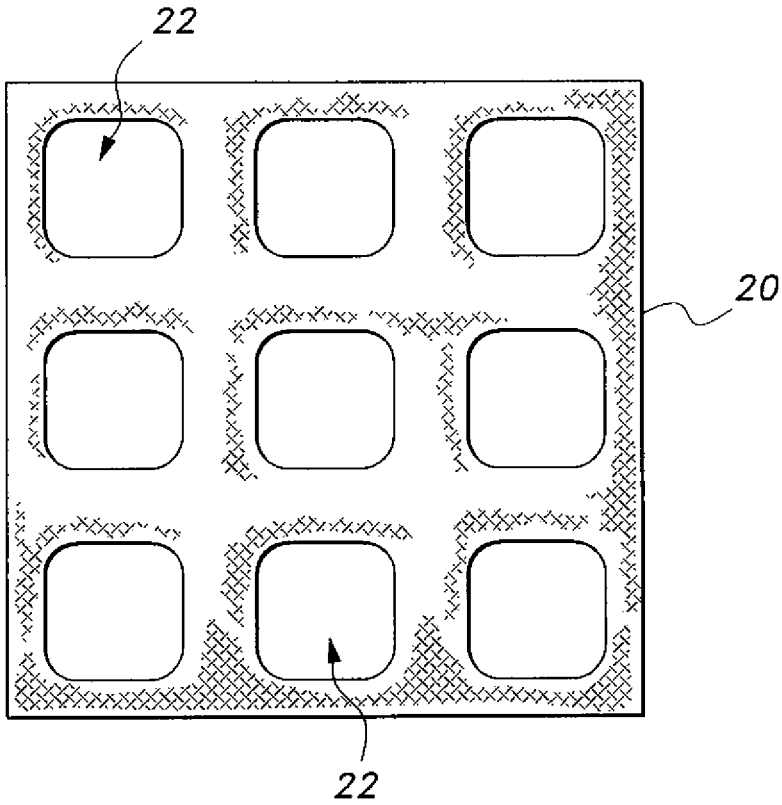
FIG. 3 is a partial end view of a baseball/softball training pouch according to the present invention.

Attention is directed to FIGS. 1-3, wherein the baseball/softball training pouch is generally indicated at 10. The pouch 10 comprises an elongate, sleeve-like member 12 having an open end 14 and a closed end 16. An adjustable padded wristband 18 defines open end 14. Although hook and loop fasteners 14*a*, 14*b* are preferred, any conventional fasteners can be utilized with the wristband to secure the pouch 12 on the wrist of a user. Pouch 12 and wristband 18 are fabricated from an elastic material, such as spandex. Use of an elastic material permits the pouch 12 to absorb a portion of the force of the ball thrown therein, thereby reducing potential shock on the wrist and prolonging the life of the pouch. An observation member 20 is fixed to pouch 12 at closed end 16. The observation member 20 is provided with openings 22 therethrough. The openings 22 permit a coach or other observer to view finger placement and grip technique for possible correction. The observation member 20 may also be provided with a detection device 20*a* therein for measuring the force of ball as it impacts the closed end of the pouch. The force measurements can be translated into ball speed.

In use, the pouch 12 is placed over the handheld ball, and the wristband 18 is adjusted to secure the pouch 12 to the wrist. The ball is grasped in the desired grip. The grip may be observed via openings 22 and critiqued by a coach or the like, if necessary. Thereafter, the user can throw the ball utilizing a normal pitching or throwing motion. The thrown ball will impact the closed end of the pouch for quick and easy retrieval.

It is to be understood that the present invention is not limited to the embodiments described above, but encompasses any and all embodiments within the scope of the following claims.

I claim:

1. A baseball/softball training pouch, consisting of:

an elongate pouch having a longitudinal axis and including a single, continuous wall enclosing a volume therein, the pouch having an open end and a closed end, the open end being adapted for receiving a handheld ball therethrough, wherein the pouch is fabricated from an elastic material;

an adjustable wristband attached to the elongate pouch adjacent the open end, whereby the pouch is secured on the wrist of a user, wherein the wristband is fabricated from an elastic material and defines the sole attachment to a user;

an observation member attached to the elongate pouch at the closed end for viewing the enclosed volume along the axial length of the pouch; and a force detection device attached to the observation member for detecting the impact force of a thrown ball.

2. The baseball/softball training pouch according to claim 1, wherein said observation member is provided with a plurality of openings therethrough.

3. The baseball/softball training pouch according to claim 1, wherein said ball is a baseball.

4. The baseball/softball training pouch according to claim 1, wherein said ball is a softball.

5. The training device according to claim 1, wherein said adjustable wristband comprises hook and loop fasteners.

6. The baseball/softball training pouch according to claim 1, wherein said adjustable wristband is padded.

* * * * *